US005280980A

United States Patent [19]

Coatta

[11] Patent Number: 5,280,980

[45] Date of Patent: Jan. 25, 1994

[54] SELF-ALIGNING TWIN CONTAINER SPREADER

[75] Inventor: Stephen J. J. Coatta, Coquitlam, Canada

[73] Assignee: Earl's Industries Ltd., Vancouver, Canada

[21] Appl. No.: 996,731

[22] Filed: Dec. 24, 1992

[51] Int. Cl.[5] ..... B66C 1/10

[52] U.S. Cl. ..... 294/81.1; 294/81.21

[58] Field of Search ..... 294/68.3, 81.1, 81.2, 294/81.21, 81.4, 81.41, 81.5, 81.53; 414/460, 461, 607, 608

[56] References Cited

U.S. PATENT DOCUMENTS

| | | | |
|---|---|---|---|
| 3,502,365 | 3/1970 | Callow | 294/81.1 |
| 3,536,351 | 10/1970 | Zweifel et al. | 294/81.1 |
| 3,709,543 | 1/1973 | Tax et al. | 294/81.2 |
| 3,726,426 | 4/1973 | Tingskog | 294/81.1 X |
| 3,747,970 | 7/1973 | Fathauer et al. | 294/81.1 |
| 3,863,970 | 2/1975 | Gottlieb et al. | 294/81.4 X |
| 5,183,305 | 2/1993 | Nordstrom et al. | 294/81.1 X |

FOREIGN PATENT DOCUMENTS

| | | | |
|---|---|---|---|
| 55874 | 7/1982 | European Pat. Off. | 294/81.1 |
| 1951531 | 5/1971 | Fed. Rep. of Germany | 294/81.2 |
| 2815186 | 2/1979 | Fed. Rep. of Germany | 294/81.21 |
| 275398 | 11/1989 | Japan | 294/81.4 |
| 1379969 | 1/1975 | United Kingdom | 294/81.21 |

*Primary Examiner*—Johnny D. Cherry

*Attorney, Agent, or Firm*—Barrigar & Oyen

[57] ABSTRACT

An alignment mechanism for aligning a twin container spreader for simultaneous engagement with two containers positioned beneath the spreader. A frame is connected between the spreader's main beams to position two cross beams transversely across the main beams. Twist-lock devices are provided on each end of each cross beam and on each outer end of each main beam. First and second biasing mechanisms are respectively connected between the first and second cross beams and the frame, with a third biasing mechanism connected between the two cross beams. If either container is mis-aligned, the corresponding twist-locks on the cross beams will not be aligned over the corresponding corner fittings on the top inner ends of the containers. However, the biasing mechanisms compensate by permitting the cross-beams to shift in three dimensions, thus realigning the twist-locks as they penetrate the corner fittings. As long as the container mis-alignment is not so great that the twist-locks cannot begin to enter the corner fitting apertures, the biasing mechanisms compensate by allowing the cross-beams to move as aforesaid. The biasing mechanisms thus permit the cross beams' twist-locks to center themselves within the four corner fittings on the top inner ends of the containers as they penetrate those fittings. The operation is passive, requiring no operator intervention to assist in alignment of the cross beams' twist-locks.

15 Claims, 11 Drawing Sheets

SELF-ALIGNING TWIN CONTAINER SPREADER

FIELD OF THE INVENTION

This application pertains to an alignment mechanism for aligning a twin container spreader with respect to two containers positioned beneath the spreader so that both containers can be simultaneously lifted even if they are mis-aligned with the spreader by up to about ±3 inches.

BACKGROUND OF THE INVENTION

Container spreaders are crane-operated devices used to transport freight containers between a dock and a ship berthed adjacent the dock. Spreaders are also found on container yard equipment and on other container handling equipment. Many freight containers are built according to internationally recognized standards such as ISO 668. Typically, two types of ISO standard containers are encountered: 20 and 40 foot nominal length containers.

ISO standard corner fittings are built into the four corners atop each container. ISO standard pickup devices on the spreader mate with the corner fittings. The pickup devices are hydraulically, pneumatically or mechanically actuated twist-lock devices located on the ends of slide frames which extend longitudinally from the spreader's main beams. The slide frames can be extended to lift a single 40 foot container or retracted to lift a single 20 foot container. If another set of twist-lock devices is provided in the centre of the main beams, then the spreader can simultaneously lift two 20 foot containers when the slide frames are extended. Spreaders having the latter capability are known as "twin twenty" spreaders.

If a single 40 foot container located beneath the spreader is to be lifted, the slide frames are extended to position the outer twist-locks over the container's top corner fittings. The spreader is then lowered onto the container so that the twist-locks engage the corresponding corner fittings on the container. The twist-locks are then actuated to lock them onto the corner fittings, thus firmly attaching the container to the spreader. The spreader and container are then lifted to move the container to a desired location, following which the twist-locks are released from the corner fittings so that the spreader can be raised away from the container and maneuvered into position over another container. The same sequence is used to move a single 20 foot container, the only difference being that the spreader's slide frames are retracted to position the outer twist-locks relative to the corner fittings of a 20 foot container.

Eight twist-locks are provided for configuration as a twin spreader: four twist-locks for each of the two containers. The additional four twist-locks are located centrally on the spreader. The slide frames are extended to position the outer twist-locks over the outer corners of the two containers, with the central twist-locks remaining over the inner corners. The spreader is then lowered onto the containers. Ideally, all eight twist-locks simultaneously engage the corresponding corner fittings on the containers. However, problems are often encountered because the two containers may not be perfectly aligned relative to the spreader. The twist-locks are fixed on the spreader and thus cannot be adjusted to compensate for container mis-alignment.

In particular, unless the two containers are carefully positioned within a frame provided beneath the spreader, they may be mis-aligned relative to the spreader. Such frames are not commonly used because they are relatively expensive, require increased labour to position the containers, and must be moved if the spreader moves to a new pickup location. Accordingly, container mis-alignment is often encountered. Depending upon the degree of misalignment, it may not be possible for the twist-locks to simultaneously engage both containers. Specifically, if the containers are mis-aligned by more than about ±½" it may only be possible for one of the two pairs of four twist-locks to simultaneously engage all four corner fittings on one of the containers. The operator often wastes time attempting to position the spreader so that all eight twist-locks will engage the two containers, only to give up in frustration and lift the containers one at a time. This wastes considerable time and defeats the purpose of the twin spreader.

A further problem termed "swaybacking" is encountered if two 20 foot containers are to be simultaneously lifted from the bed of a transport vehicle. The weight of the containers bends the vehicle bed downwardly, causing the top surfaces of the containers to form a shallow "v" instead of remaining level and coplanar with one another. When a twin spreader is lowered atop the two containers, the outer twist-locks may engage the outer corner fittings on the two containers, but the central twist-locks may not be able to protrude sufficiently far into the "V" recess to engage the inner corner fittings. This again wastes time by necessitating separate removal of each container from the vehicle, defeating the purpose of the twin spreader.

Another problem is encountered in lifting pairs of 20 foot containers from atop a stack of containers. As pairs of containers are stacked, cones are often placed beneath the inner corner fittings located on the bottoms of each container. The cones guide the placement of each layer of containers. Because cones are not usually placed beneath the containers' outer corners, the inner ends of the containers are raised slightly relative to the outer ends. As successive layers of containers are added to the stack, the cumulative effect of the cones beneath each layer causes the top surfaces of the uppermost containers to form a shallow "^" instead of remaining level and coplanar with one another. When a twin spreader is lowered onto two containers atop a stack of such containers, the central twist-locks may engage the inner corner fittings on the two containers, but the outer twist-locks may not be able to protrude sufficiently far into the recesses left at the ends of each container to engage the outer corner fittings. Time is again wasted as each container is separately removed from the stack and the twin spreader's purpose is again defeated.

The present invention provides a self-adjusting alignment mechanism which compensates for container mis-alignment by allowing the four central twist-locks of a twin spreader to shift in three dimensions as they engage the container corner fittings, thus enabling simultaneous lifting of two containers which are mis-aligned by as much as ±3 inches.

SUMMARY OF THE INVENTION

In accordance with the preferred embodiment, the invention provides an alignment mechanism for aligning a twin container spreader to engage first and second containers positioned beneath the spreader. The alignment mechanism consists of a frame positioned over the spreader's two main beams, first and second cross beams positioned transversely over the main beams, a twist-lock device on each end of the two cross beams, a first biasing means connected between the first cross beam and the frame, and a second biasing means connected between the second cross beam and the frame. A third biasing means is connected between the two cross beams.

The first biasing means has a first spring mechanism which extends parallel to the first main beam; and, a second spring mechanism which extends parallel to the second main beam. The second biasing means has a third spring mechanism which extends parallel to the first main beam; and, a fourth spring mechanism which extends parallel to the second main beam.

Preferably, the first biasing means also has a fifth spring mechanism extending perpendicular to the first main beam; and, a sixth spring mechanism extending perpendicular to the second main beam. Similarly, the second biasing means preferably also has a seventh spring mechanism extending perpendicular to the first main beam; and, an eighth spring mechanism extending perpendicular to the second main beam. The third biasing means has a ninth spring mechanism extending parallel to the first main beam; and, a tenth spring mechanism extending parallel to the second main beam.

Advantageously, the first, third, fifth and seventh spring mechanisms are positioned adjacent the first main beam; and, the second, fourth, sixth and eighth spring mechanisms are positioned adjacent the second main beam.

A swivel means is coupled to the spring mechanism ends to allow them to rotate. The swivel means are preferably hemi-spherical. A shaft is placed in each spring mechanism to inhibit deflection of the spring mechanisms away from their respective longitudinal axes.

Advantageously, the spring mechanisms each comprise a spring, first and second sleeves extending within the opposed ends of the spring, a pin slidably coupled between the sleeves, and a pin centering means for urging the pin away from the spring ends. The sleeve outer ends have hemi-spherical heads which mate with hemi-spherical connectors used to rotatably connect the heads to the respective cross beams and frame.

DETAILED DESCRIPTION OF THE PREFERRED EMBODIMENT

Figure 1:
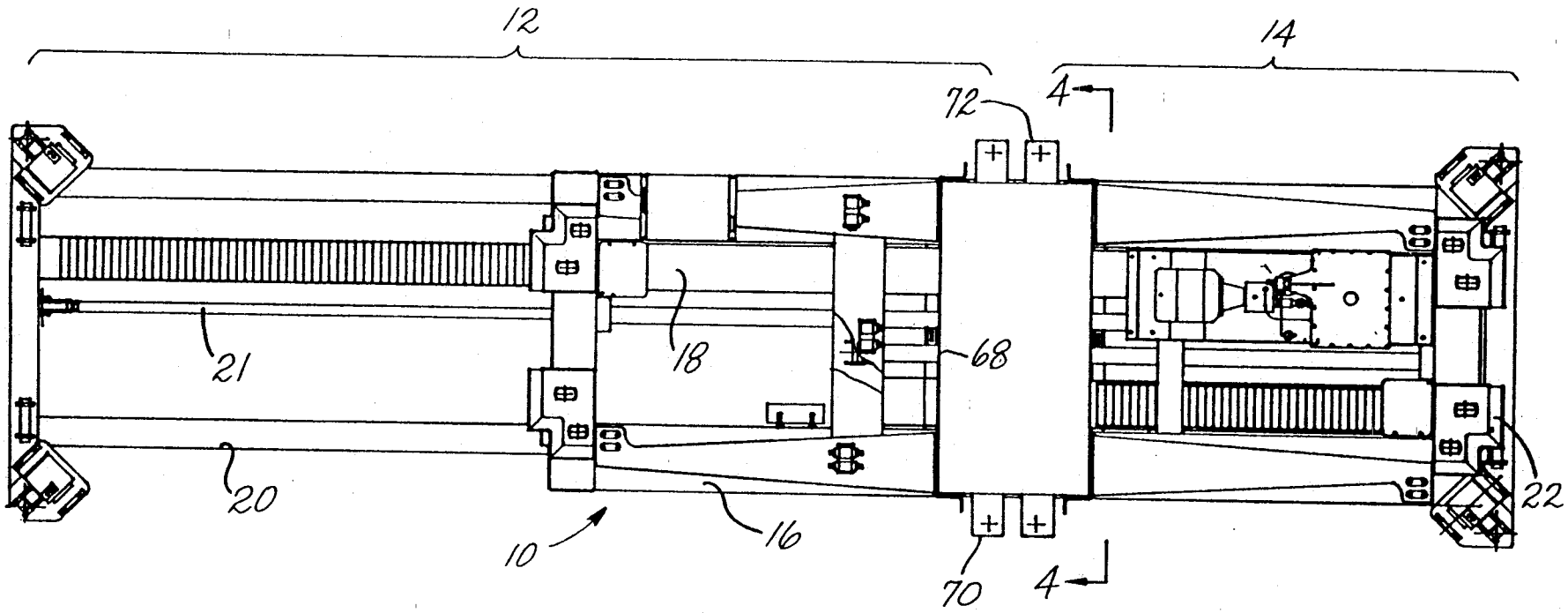
FIG. 1 is a top plan view of a twin spreader having an alignment mechanism constructed in accordance with the preferred embodiment of the invention.
Figure 2:
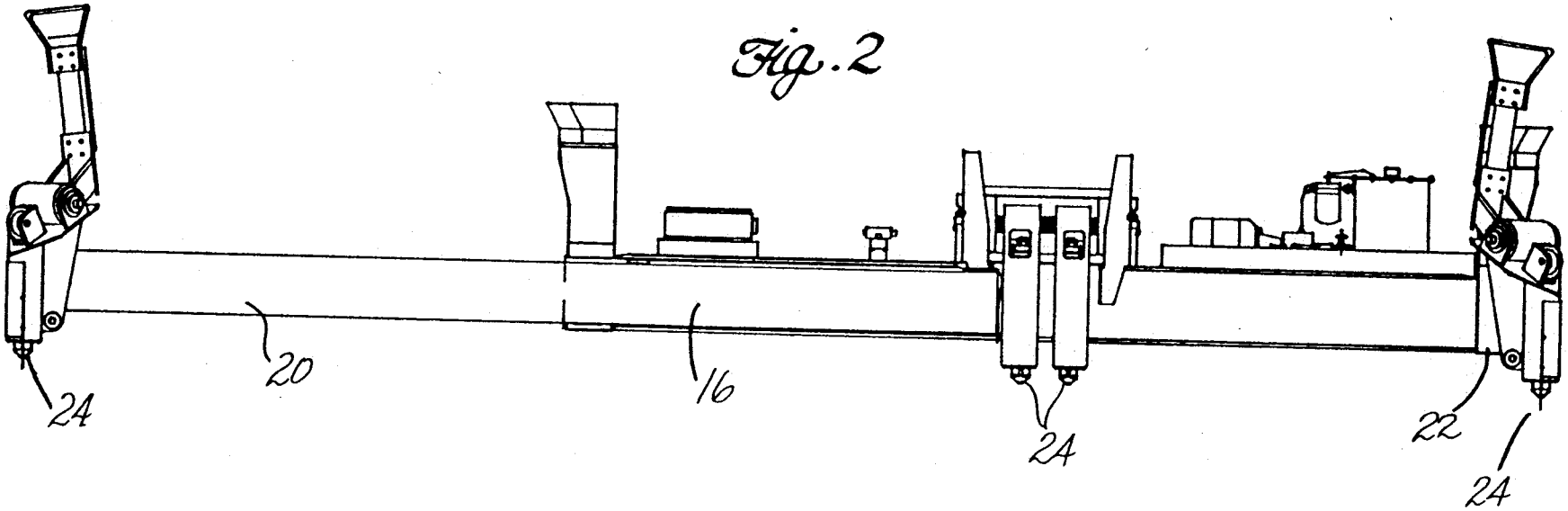
FIG. 2 is a front elevation view of the spreader of FIG. 1.
Figure 3:
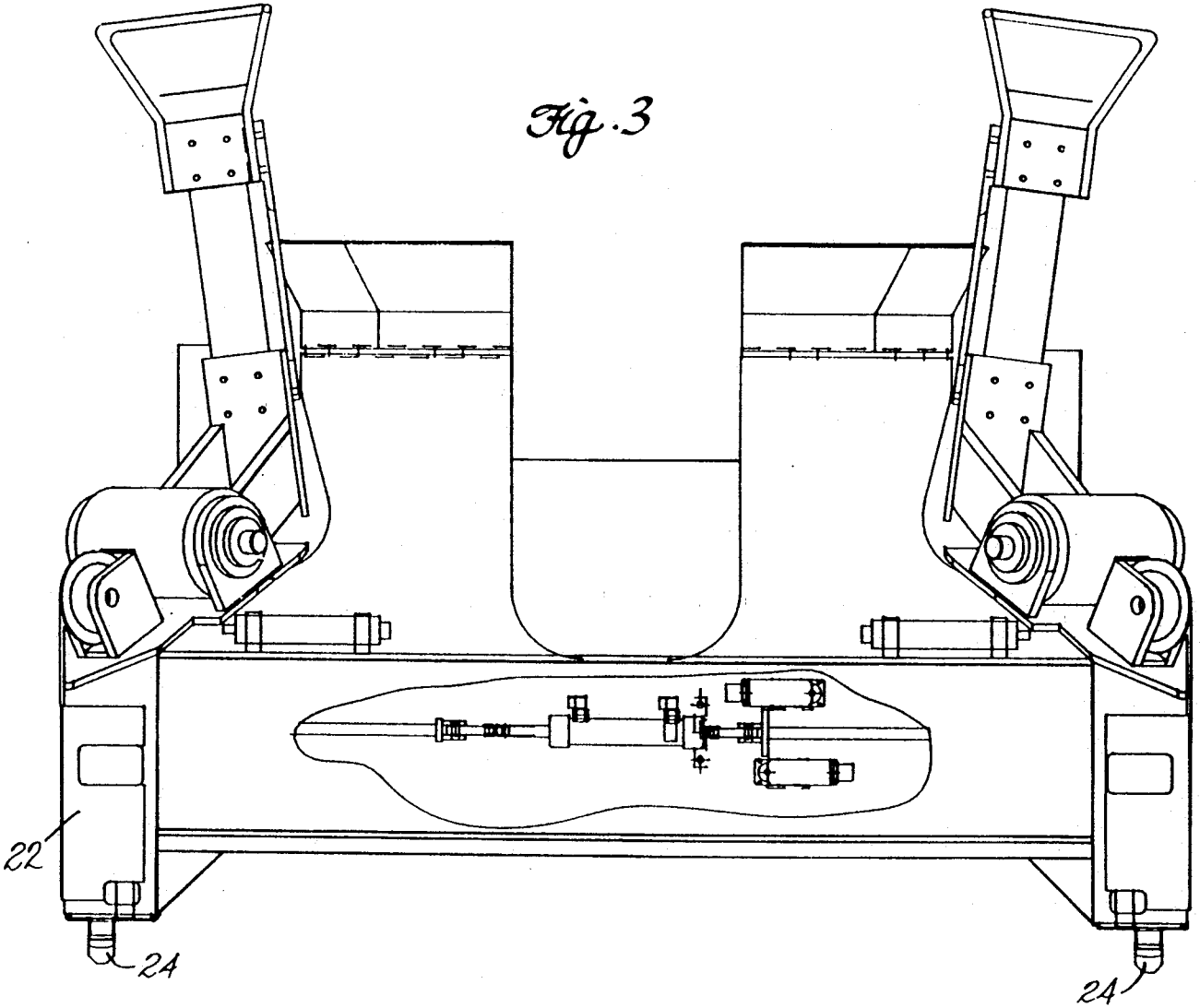
FIG. 3 is an enlarged, partially fragmented end view of the spreader of FIGS. 1 and 2.
Figure 4:
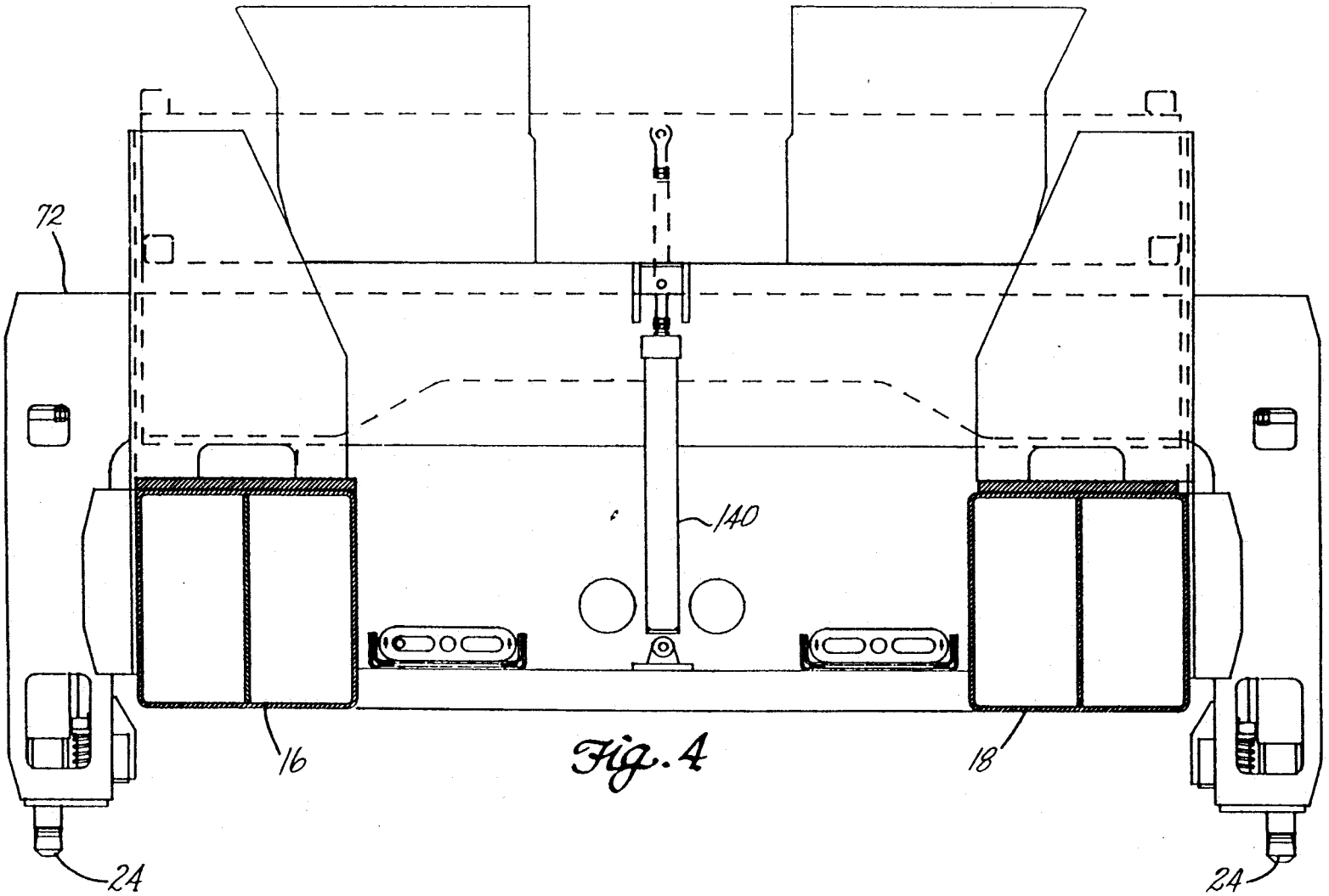
FIG. 4 is a cross-sectional view of the spreader of FIG. 1, taken with respect to line 4—4 of FIG. 1.

FIGS. 1 and 2 depict a spreader 10 having a first (i.e. left hand) half 12 and a second (i.e. right hand) half 14. For purposes of illustration only, first half 12 is shown telescopically extended to its maximum length, and second half 14 is shown telescopically retracted to its minimum length. In practice, the two halves are either both extended to accommodate one 40 foot container or two 20 foot containers, or they are both retracted to accommodate a single 20 foot container.

Spreader 10 incorporates first and second main beams 16, 18. A first slide frame 20 is mounted for telescopically slidable movement, by hydraulic cylinder 21, relative to the left hand ends of main beams 16, 18. Similarly, a second slide frame 22 is mounted for hydraulically actuated telescopic extension or retraction within the right hand ends of main beams 16, 18. Four conventional hydraulically actuated "container locking means", namely twist-lock devices 24 conforming to ISO 668, are provided at the two outer corners of each of slide frames 20, 22. These four twist-locks engage the four top corners of a single 20 or 40 foot container when spreader 10 operates as a single container spreader. The same four twist-locks engage the top outer corners of a pair of 20 foot containers when spreader 10 operates as a twin spreader.

Figure 5:
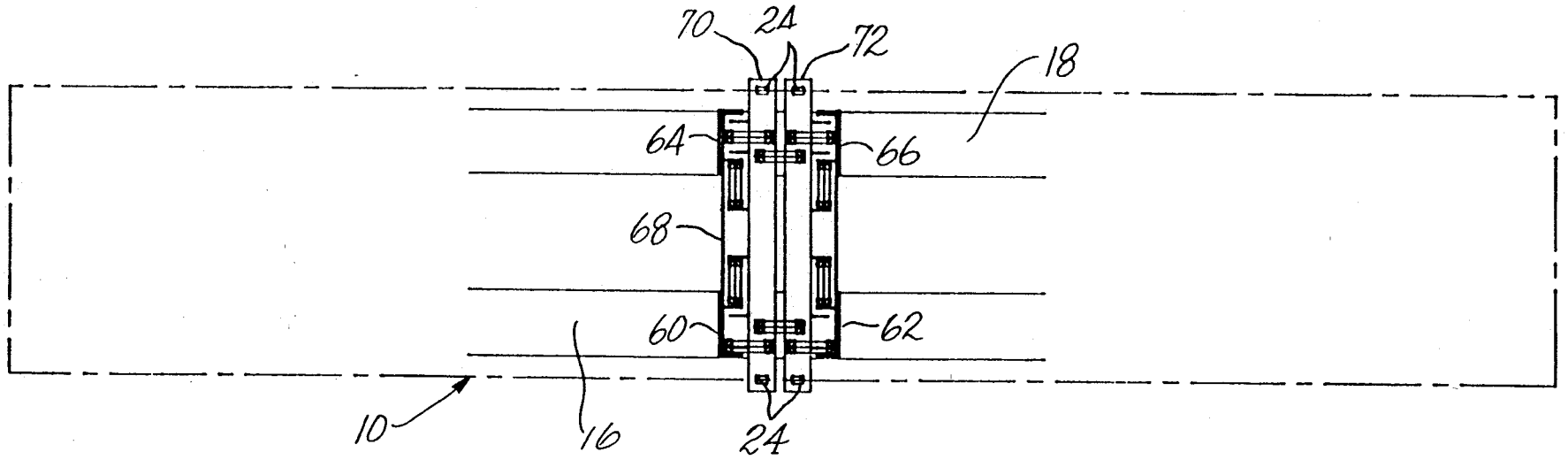
FIG. 5 is a partially schematic top plan view of the spreader of FIG. 1, showing the alignment mechanism without its top cover plate.
Figure 6:
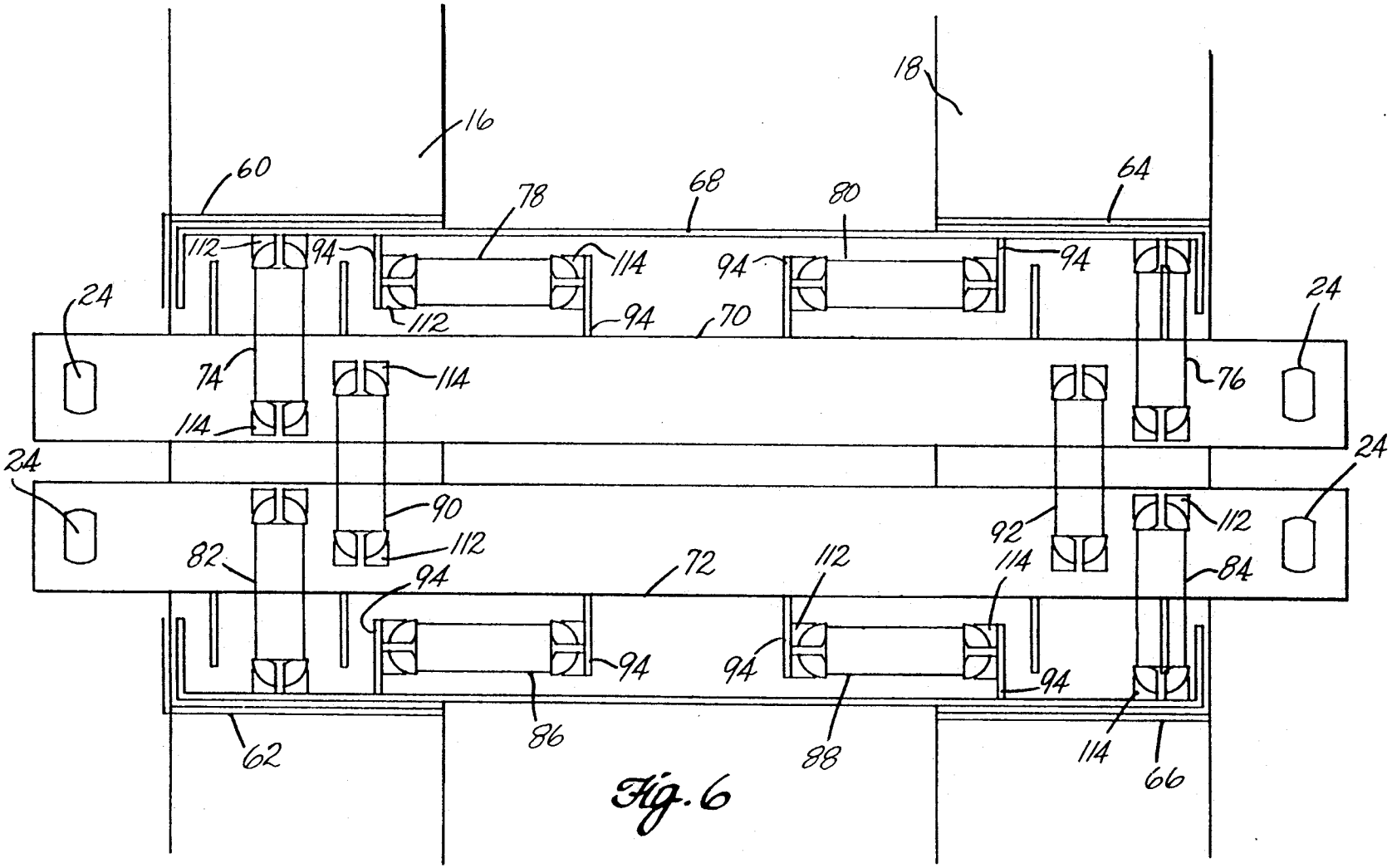
FIG. 6 is an enlarged view of the alignment mechanism shown in FIG. 5, positioned transversely relative to the FIG. 5 depiction.

As best seen in FIGS. 5 and 6, corner plates 60, 62, 64, 66 are welded to the upper central portions of main beams 16, 18 to form a rectangular enclosure into which rectangular frame 68 may be lowered. First and second cross-beams 70, 72 are laid atop frame 68, transversely to main beams 16, 18. Cross-beams 70, 72 are not connected to main beams 16, 18. Another four conventional twist-lock devices 24 are provided on the opposed ends of each of cross-beams 70, 72. These are the four central twist-locks which engage the top inner corners of a pair of 20 foot containers when spreader 10 operates as a twin spreader.

A "first biasing means" comprising spring mechanism 74, 76, 78, 80 is connected between cross-beam 70 and frame 68. Springs 74, 76 extend parallel to main beams 16, 18 and perpendicular to cross-beams 70, 72 whereas springs 78, 80 extend perpendicular to main beams 16, 18 and parallel to cross-beams 70, 72. A "second biasing means" comprising another four spring mechanisms 82, 84, 86, 88 is connected between cross-beam 72 and frame 68. Springs 82, 84 extend parallel to main beams 16, 18 and perpendicular to cross-beams 70, 72 whereas springs 86, 88 extend perpendicular to main beams 16, 18 and parallel to cross-beams 70, 72. A "third biasing means" comprising spring mechanisms 90, 92 is connected between cross-beams 70, 72. Springs 90, 92 extend parallel to main beams 16, 18 and perpendicular to cross-beams 70, 72.

A series of plates 94 are welded to the inner sides of frame 68 or to the outer sides of cross-beams 70, 72 to support the opposed ends of springs 78, 80, 86, 88. The opposed ends of the other springs 74, 76, 82, 84, 90, 92 are directly supported by frame 68 or by one or the other of cross-beams 70, 72.

Figure 7:
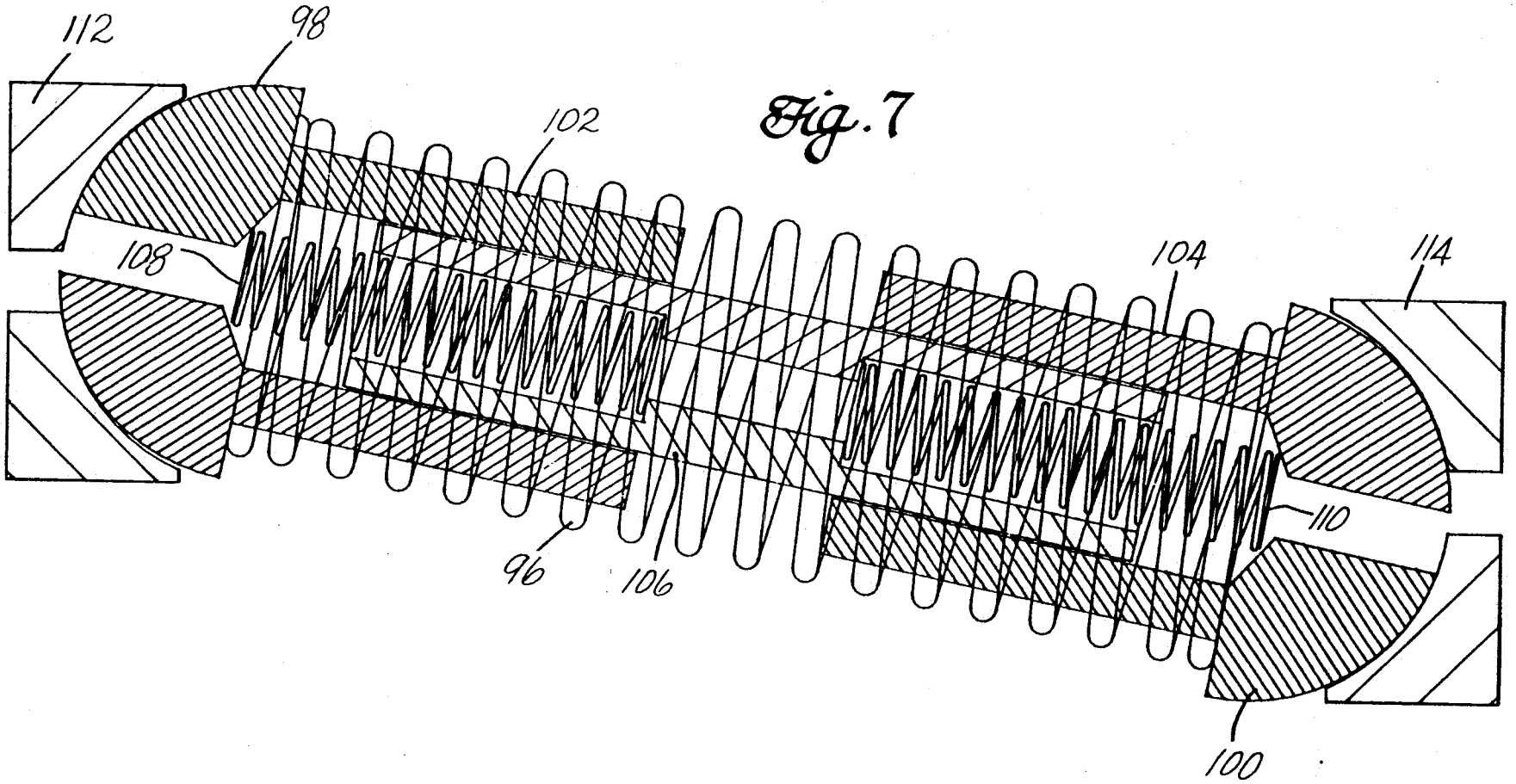
FIG. 7 is an enlarged view of one of the alignment devices depicted in FIG. 6 and illustrates how the devices are mounted to accommodate movement between their respective ends.

FIG. 7 depicts a single spring mechanism identical to each of spring mechanisms 74, 76, 78, 80, 82, 84, 86, 88, 90 and 92. As shown in FIG. 7, spring 96 is compressed between a pair of hemi-spherical heads 98, 100 provided on the respective ends of cylindrical sleeves 102, 104. Sleeves 102, 104 extend toward one another within spring 96 but the sleeve ends do not meet. The opposed ends of pin 106 (which may be a hollow cylindrical member) slidably extend within the opposed cylindrical apertures of sleeves 102, 104. The combination of sleeves 102, 104 and pin 106 inhibits deflection of spring 96 away from its longitudinal axis. A "pin centering means" such as springs 108, 110 is preferably provided to urge pin 106 into a central position away from the ends of spring 96. Hemispherical connectors 112, 114 are fixed to the elements between which spring 96 operates (for example, connectors 112, 114 are fixed to plates 94 in the case of springs 78, 80, 86, 88). Hemi-spherical heads 98, 100 mate with connectors 112, 114 in a manner which permits heads 98, 100 to rotate in any direction relative to connectors 112, 114.

Figure 8:
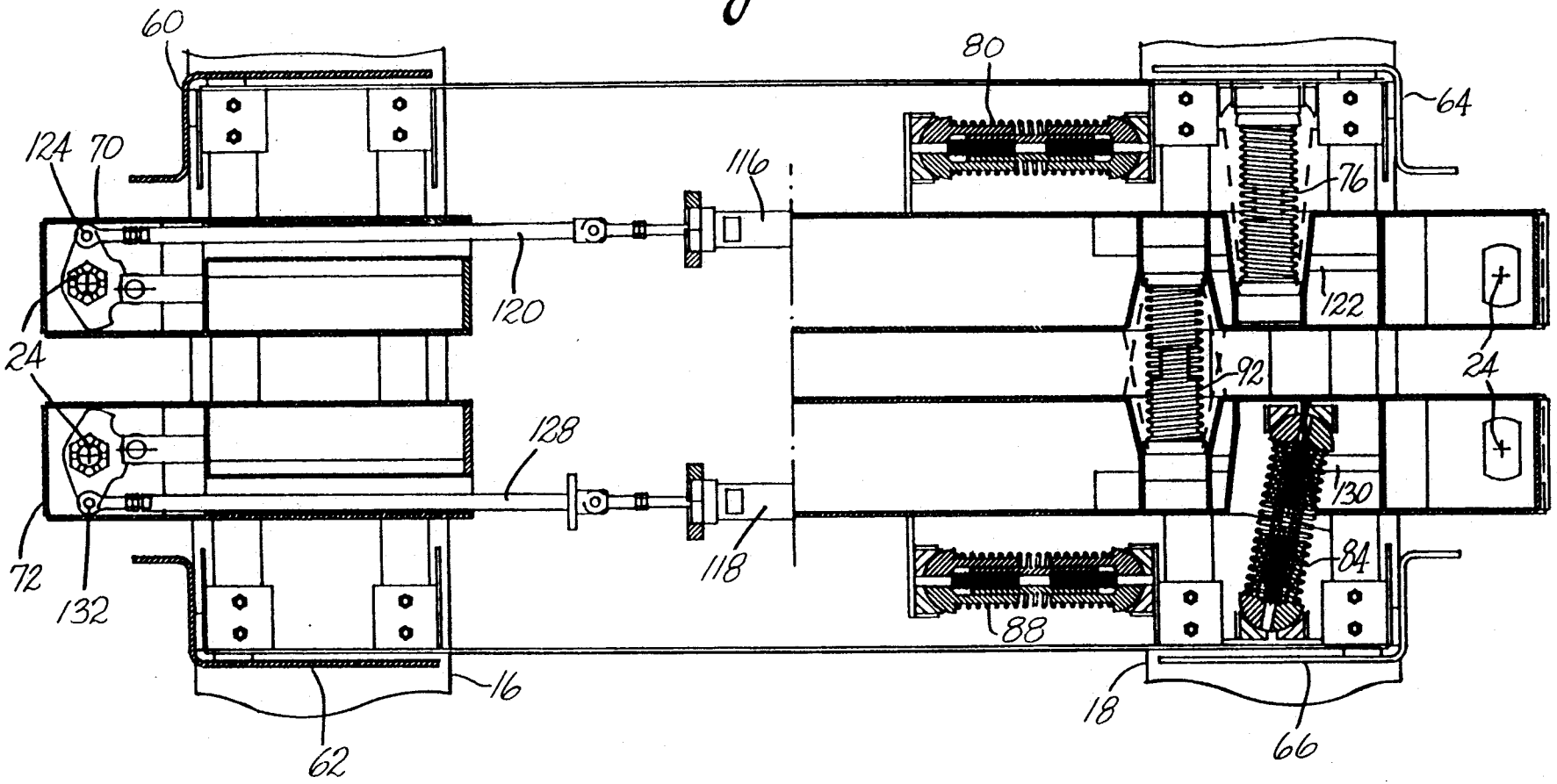
FIG. 8 is a partially fragmented top plan view of the alignment mechanism of FIG. 6, with the cross beams substantially removed to show the twist-lock actuator mechanisms, and showing how the alignment devices accommodate movement between their respective ends.
Figure 9:
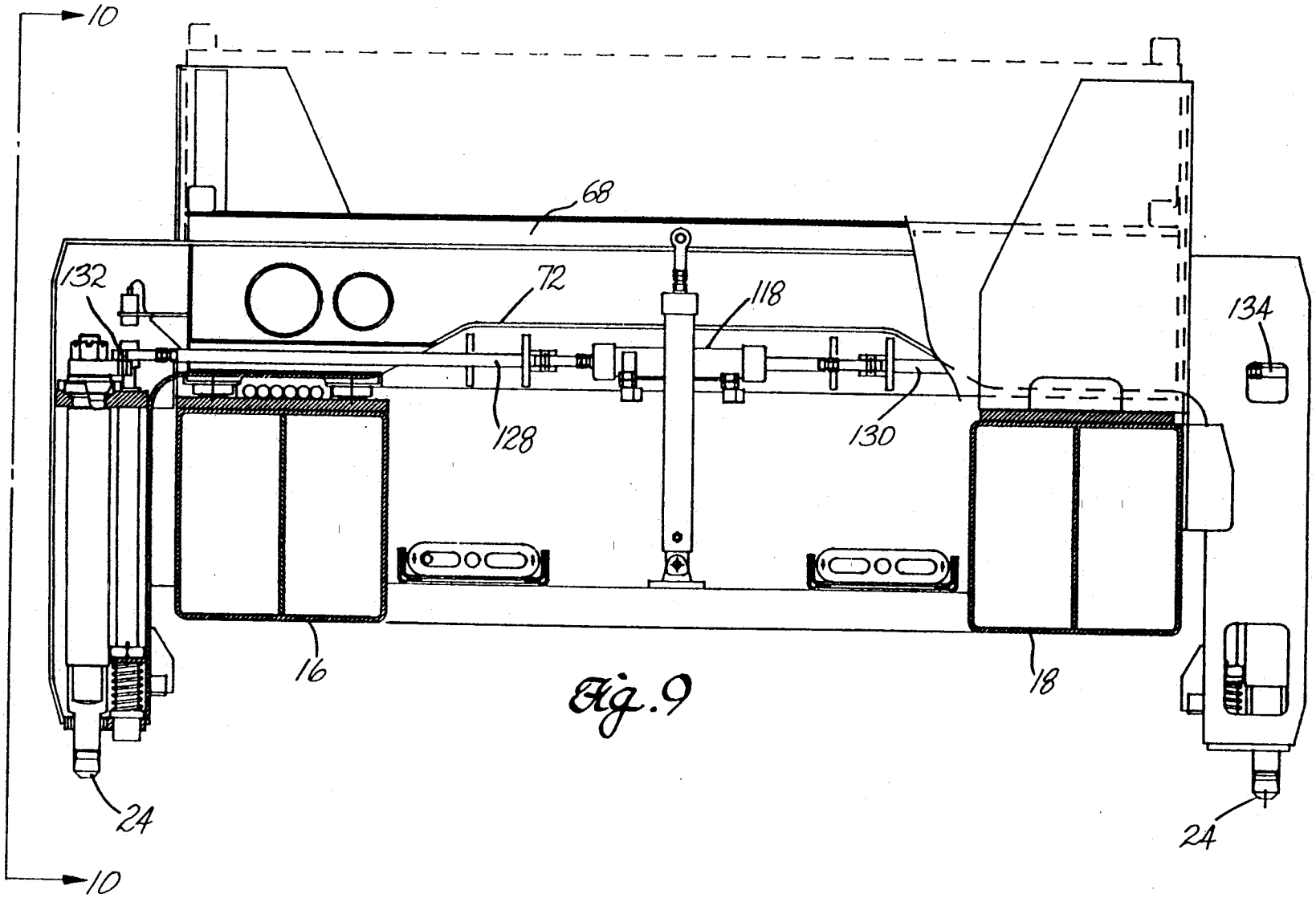
FIG. 9 is a partially fragmented side elevation view of the apparatus depicted in FIG. 8.

As shown in FIGS. 8 and 9, a pair of dual-rod hydraulic cylinders 116, 118 are provided beneath cross-beams 70, 72 respectively. Cylinder 116 is coupled by rods 120, 122 and pivot linkages to the two twist-lock devices 24 which project downwardly from the opposed ends of cross-beam 70. Only one such pivot linkage 124 is visible in FIG. 8; the other pivot linkage is obscured by the right hand end of cross-beam 70. Similarly, cylinder 118 is coupled by rods 128, 130 and pivot linkages 132, 134 to the two twist-lock devices 24 which project downwardly from the opposed ends of cross-beam 72.

In operation, spreader 10 is adjusted by extending or retracting slide frames 20, 22. The slide frames are retracted if spreader 10 is to lift a single 20 foot container. They are extended if spreader 10 is to lift a single 40 foot container or two 20 foot containers. It will be assumed that the slide frames are extended to configure spreader 10 as a twin spreader, since the invention is directed to the twin spreader function.

Hydraulic cylinder 140 (FIGS. 9 and 10) is actuated to lower frame 68 such that cross beams 70, 72 rest atop main beams 16, 18. This lowers the four central twist-lock devices 24 on the ends of cross-beams 70, 72 into horizontal alignment with the four outer twist-lock devices 24 on the ends of slide frames 20, 22. Spreader 10 is positioned over a pair of 20 foot containers and lowered onto the tops of the containers. The lower, tapered ends of twist-lock devices 24 penetrate apertures provided in the tops of the respective container corner fittings. Twist-lock devices 24 are then actuated to rotate them through 90°, thereby locking them onto the container corner fittings. Spreader 10 is then raised, with both containers, and maneuvered to a desired location, at which twist-lock devices 24 are actuated to release them from the container's corner fittings so that spreader 10 can be lifted clear of the containers and maneuvered into a new position to lift two more containers.

If the two containers are mis-aligned, then the four central twist-lock devices 24 will not be aligned over the corresponding corner fittings on the inner ends of the containers. However, the spring mechanisms compensate by permitting cross-beams 70, 72 to shift in three dimensions, thus realigning the twist-lock devices as they penetrate the corner fittings. As long as the container mis-alignment is not so great that the tapered lower ends of twist-lock devices 24 cannot begin to enter the corner fitting apertures, the spring mechanisms can compensate by allowing the cross-beams to move as aforesaid. The spring mechanisms thus permit the four central twist-lock devices to center themselves within the four corner fittings on the inner ends of the containers as they penetrate those fittings. The operation is passive, requiring no operator intervention to assist in alignment of the central twist-lock devices. After the containers are moved and spreader 10 released therefrom, the spring mechanisms return the central twist-lock devices to their initial neutral positions in which they are aligned for engagement with two containers having no mis-alignment. Any three dimensional container mis-alignment (including mis-alignment caused by swaybacking or by the use of stacking cones) can be accommodated, within a range of about ±3 inches.

FIG. 8 shows several examples of the range of motion permitted by the spring mechanisms. For example, spring mechanism 84 is shown at an angle relative to spring mechanism 76. This position of spring mechanism 84 accommodates movement of the right hand end of cross-beam 72, allowing the twist-lock device at that end of cross-beam 72 to centre itself as it enters the corner fitting of a misaligned container. The dotted lines adjacent spring mechanisms 76, 92 show further examples of the motion permitted by those mechanisms as the twist-lock devices centre themselves upon entry into the corner fittings of mis-aligned containers.

The invention can be retrofitted to twin spreaders having no alignment capability. In particular, the alignment mechanism hereinbefore described is a self-contained unit incorporating its own cross-beams and twist-lock devices, together with a mechanism for accommodating adjusting movement of the cross-beams in three dimensions to permit correspondingly adjustable placement of the twist-lock devices within the corner fittings of a container.

Figure 10:
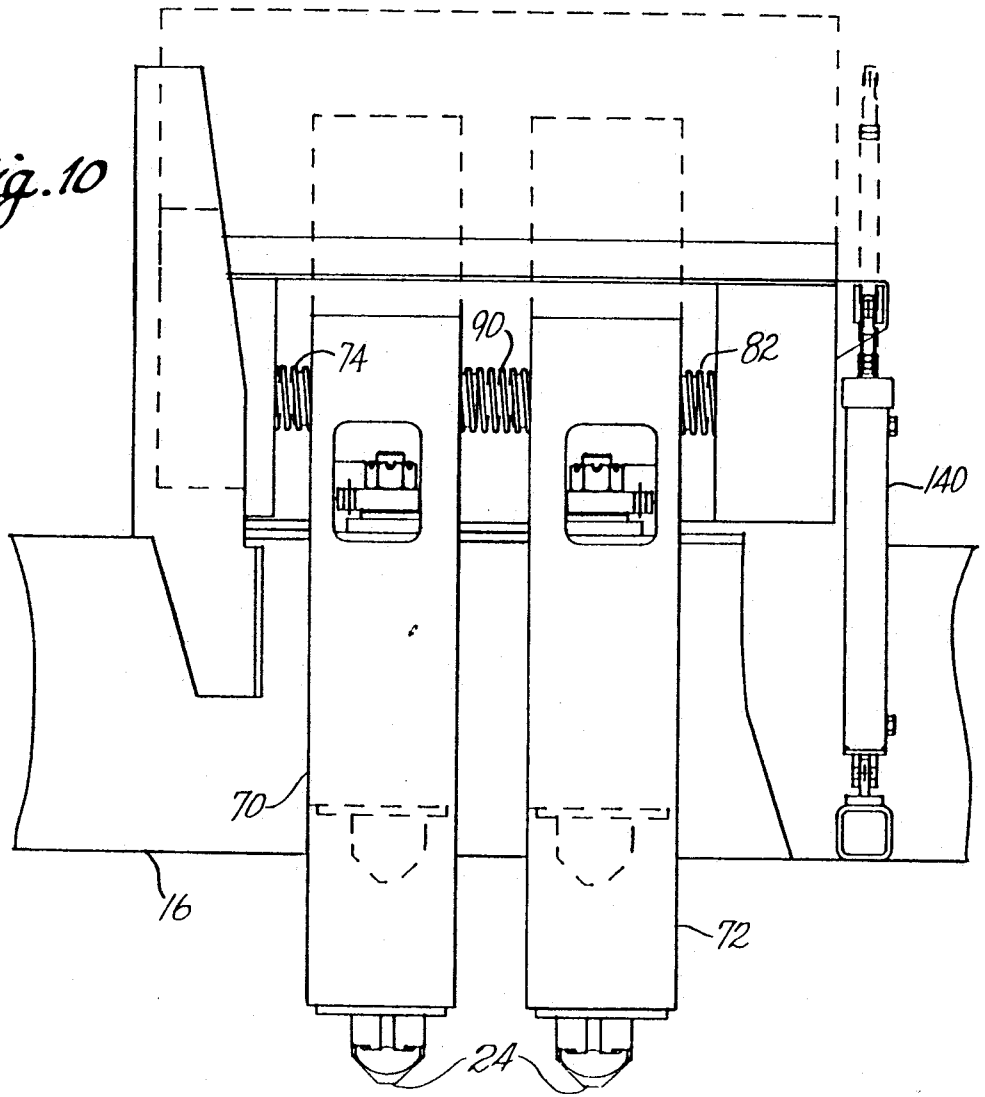
FIG. 10 is an end view, taken with respect to line 10—10 of FIG. 9.

If spreader 10 is to lift a single container, this is easily accomplished by actuating cylinder 140 to raise the alignment mechanism upwardly away from main beams 16, 18 into the position shown partially in dotted outline in FIGS. 9 and 10. This raises the four central twist-lock devices 24 on cross-beams 70, 72 away from the centre of the container, preventing potential damage to the container which could result if the alignment mechanism were left in place such that the central twist-lock devices could puncture the central roof portion of the container.

Figure 11:
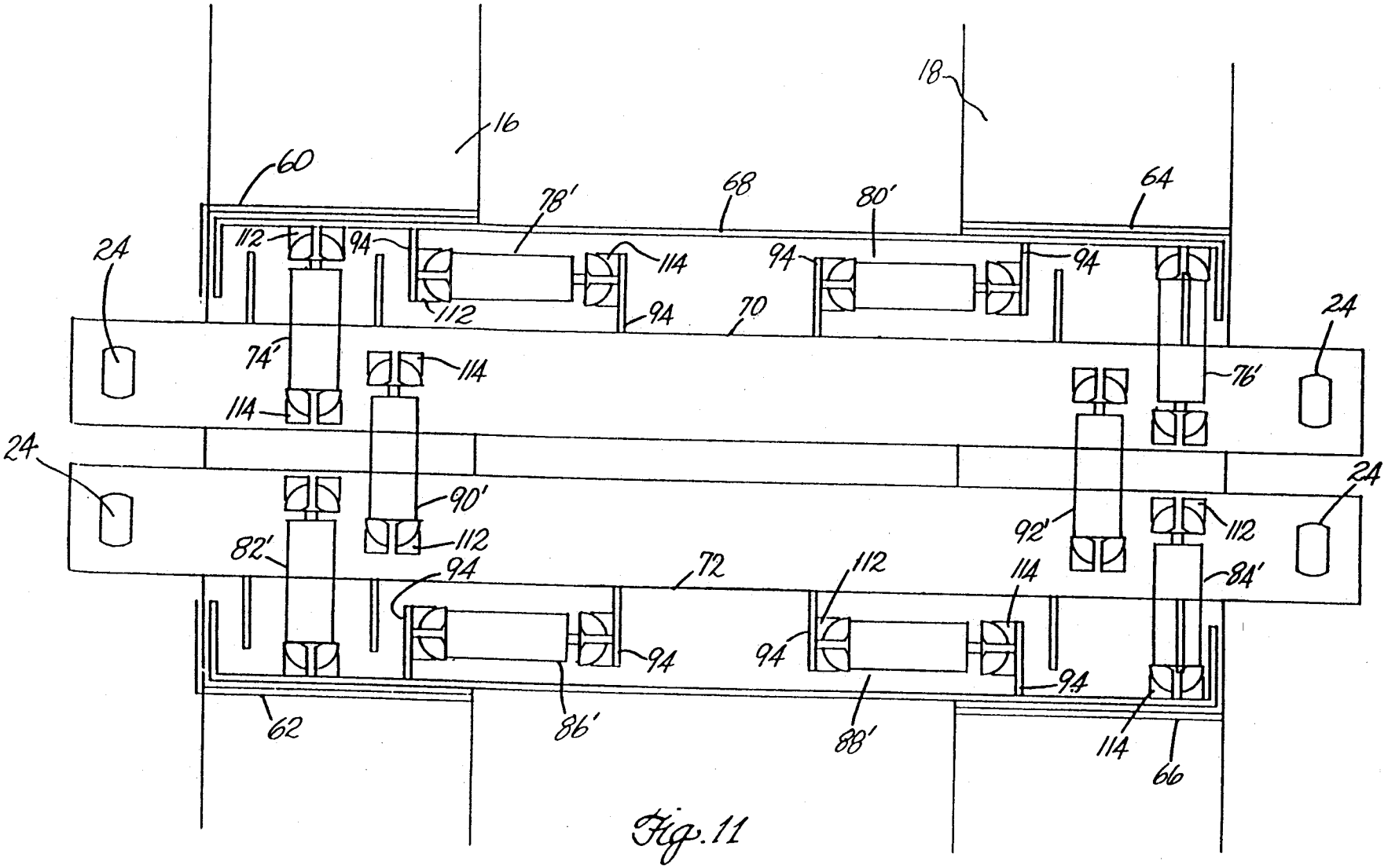
FIG. 11 is an enlarged view of the alignment mechanism, the lines of FIG. 6 replacing spring mechanisms with gas charged accumulators.

As will be apparent to those skilled in the art in the light of the foregoing disclosure, many alterations and modifications are possible in the practice of this invention without departing from the spirit or scope thereof. For example, instead of using spring mechanisms to form the various biasing means, one could alternatively use gas-charged accumulator devices, 74', 76', 78', 80', 82', 84', 86', 88', 90' and 92' in place of the spring mechanisms 74, 76, 78, 80, 82, 84, 86, 88, 90 and 92 as depicted in FIG. 11. Accordingly, the scope of the invention is to be construed in accordance with the substance defined by the following claims.

What is claimed is:

1. An alignment mechanism for aligning a twin container spreader to engage first and second containers positioned beneath said spreader, said alignment mechanism comprising:
(a) a frame positioned over first and second main beams of said spreader;
(b) first and second cross beams positioned transversely over said first and second main beams;
(c) container locking means on each end of said first and second cross beams;
(d) first biasing means connected between said first cross beam and said frame; and,
(e) second biasing means connected between said second cross beam and said frame.

2. An alignment mechanism as defined in claim 1, further comprising third biasing means connected between said first and second cross beams.

3. An alignment mechanism as defined in claim 2, wherein:
(a) said first biasing means further comprises:
(i) a first spring mechanism extending parallel to said first main beam;
(ii) a second spring mechanism extending parallel to said second main beam;
(b) said second biasing means further comprises:
(i) a third spring mechanism extending parallel to said first main beam; and,
(ii) a fourth spring mechanism extending parallel to said second main beam.

4. An alignment mechanism as defined in claim 3, wherein:
(a) said first biasing means further comprises:
(i) a fifth spring mechanism extending perpendicular to said first main beam;
(ii) a sixth spring mechanism extending perpendicular to said second main beam;
(b) said second biasing means further comprises:
(i) a seventh spring mechanism extending perpendicular to said first main beam; and,
(ii) an eighth spring mechanism extending perpendicular to said second main beam.

5. An alignment mechanism as defined in claim 4, wherein said third biasing means further comprises:
(a) a ninth spring mechanism extending parallel to said first main beam; and,
(b) a tenth spring mechanism extending parallel to said second main beam.

6. An alignment mechanism as defined in claim 4, wherein:
(a) said first, third, fifth and seventh spring mechanisms are positioned adjacent said first main beam; and,
(b) said second, fourth, sixth and eighth spring mechanisms are positioned adjacent said second main beam.

7. An alignment mechanism as defined in claim 4, further comprising swivel means coupled to said spring mechanism ends, said swivel means for accommodating rotation of said spring mechanism ends.

8. An alignment mechanism as defined in claim 7, wherein said swivel means are hemi-spherical.

9. An alignment mechanism as defined in claim 4, further comprising shaft means within each of said spring mechanisms for inhibiting deflection of said spring mechanisms away from a longitudinal axis of said respective spring mechanisms.

10. An alignment mechanism as defined in claim 4, wherein said spring mechanisms each further comprise:
(a) a spring;
(b) first and second sleeves extending within opposed first and second ends of said spring;
(c) a pin slidably coupled between said sleeves; and,
(d) pin centering means for urging said pin away from said spring ends.

11. An alignment mechanism as defined in claim 10, further comprising:
(a) first and second hemi-spherical heads on said respective first and second sleeve outer ends; and,
(b) hemi-spherical connectors for mating hemi-spherical connection of said heads to said respective cross beams and frame.

12. An alignment mechanism as defined in claim 4, wherein said biasing means are gas-charged accumulators.

13. An alignment mechanism as defined in claim 4, further comprising means for vertically displacing said frame and cross beams relative to said main beams.

14. An alignment mechanism as defined in claim 3, further comprising means for vertically displacing said frame and cross beams relative to said main beams.

15. An alignment mechanism as defined in claim 2, further comprising means for vertically displacing said frame and cross beams relative to said main beams.

* * * * *